United States Patent [19]

Schnarel, Jr. et al.

[11] Patent Number: 4,720,703

[45] Date of Patent: Jan. 19, 1988

[54] DISPLAY METHOD AND APPARATUS EMPLOYING CURSOR PANNING

[75] Inventors: Charles B. Schnarel, Jr., Aloha; Allen Wirfs-Brock, Sherwood, both of Oreg.

[73] Assignee: Tektronix, Inc., Beaverton, Oreg.

[21] Appl. No.: 47,573

[22] Filed: May 4, 1987

Related U.S. Application Data

[63] Continuation of Ser. No. 637,375, Aug. 2, 1984, abandoned.

[51] Int. Cl.[4] ..... G09G 1/16

[52] U.S. Cl. ..... 340/709; 340/721; 340/724

[58] Field of Search ..... 340/709, 721, 723, 724, 340/726; 178/18

[56] References Cited

U.S. PATENT DOCUMENTS

| | | | |
|---|---|---|---|
| 3,576,574 | 4/1971 | Baskin et al. | 340/707 |
| 3,903,510 | 9/1975 | Zobel | 340/726 |
| 4,442,495 | 4/1984 | Sukonick | 340/726 |
| 4,663,617 | 5/1987 | Stockwell | 340/721 |

*Primary Examiner*—Gerald L. Brigance

*Attorney, Agent, or Firm*—John P. Dellett; Robert S. Hulse

[57] ABSTRACT

In a graphics display system, a cursor is used to pan a viewport relative to a block of stored information only part of which is selectable to be viewed through the viewport. As long as a cursor remains within the viewport, it can be utilized in a conventional manner under the control of a mouse or the like to provide interaction with display information. When the cursor is moved outside the viewport of the display, the viewport is panned to include the cursor.

11 Claims, 5 Drawing Figures

DISPLAY METHOD AND APPARATUS EMPLOYING CURSOR PANNING

This is a continuation of application Ser. No. 06/637,375 filed Aug. 2, 1984 and now abandoned.

BACKGROUND OF THE INVENTION

The present invention relates to a graphics display method and apparatus and particularly to such method and apparatus wherein a viewport is panned within a larger virtual screen area employing a movable cursor.

A known apparatus for providing a graphics computer terminal display includes a cathode-raytube portraying an image which is refreshed from a pixel bit map memory wherein each of the elementary bits of the image are stored. There is not always a one-to-one relationship between the information represented on the cathode-ray-tube screen and the size of the pixel bit map memory from which the screen information is derived. Thus, the pixel bit map memory may represent a larger virtual screen while the cathode-ray-tube presentation represents a window or viewport into the larger virtual screen. That is the cathode-ray-tube image is a visible version of part of the virtual screen stored in memory. In such case, more than one screen presentation may be simultaneously stored in memory and the visual presentation on the screen can be switched between the blocks of stored information. Although some selection can be made relative to the portion of the virtual screen which is to be displayed, the prior art did not provide a convenient way of "panning" the viewport window with respect to the virtual screen stored in memory.

SUMMARY OF THE INVENTION

In accordance with the present invention in a particular embodiment thereof, a graphics display device is provided with a "mouse" or other graphical input device which cooperates with means for addressing the display device's bit map memory so that a viewport into the bit map memory can be panned in conjunction with a cursor controlled by the mouse. In particular, if the mouse is operated for moving the cursor within the viewport displayed on the cathode-ray-tube screen until the edge of the viewport is encountered, the addressing of the bit map memory is changed whereby the whole viewport appears to be moved by the cursor. Thus, if a transition is made in cursor movement from a location "inside" the viewport to a location "outside" the viewport, the viewport is redefined such that the cursor falls just within the viewport, as long as the dimensions of the virtual screen in the bit map memory are not exceeded. In practice, for each incremental movement of the cursor, the viewport will move in the same direction by the same amount until the edge of the virtual screen in memory is reached. The cursor under the control of a mouse can be utilized for pointing to and identifying any information in the entire virtual screen, with the viewport moving along with the cursor whenever the edge of the viewport is encountered by the cursor.

It is accordingly an object of the present invention to provide an improved method and apparatus for positioning a viewport relative to a larger virtual screen.

It is another object of the present invention to provide an improved method and apparatus for panning a graphics viewport relative to bit map memory information under operator control.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DARWINGS

FIGS. 1*a* and 1*b* the position of a view port window relative to a larger virtual image space, FIG. 2 is a block diagram of a portion of apparatus according to the present invention for presenting a viewport on a cathode-ray-tube from information stored in bit map memory, FIG. 3 is a block diagram of circuitry for positioning a display cursor under the control of a mouse or the like and for changing the position of the aforementioned viewport when the cursor makes a transition with respect to a viewport edge, and FIG. 4 is a flow chart depicting a process for moving the aforementioned viewport in conjunction with a cursor as the cursor makes a transition relative to the edge of the viewport.

DETAILED DESCRIPTION

Figure 1A:
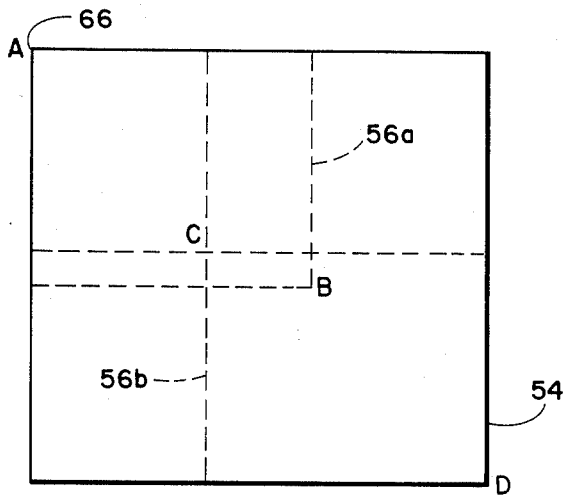
Figure 1B:
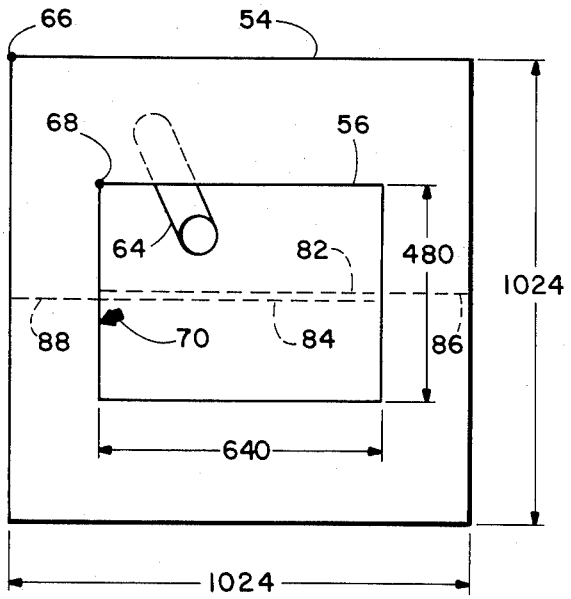
Figure 2:
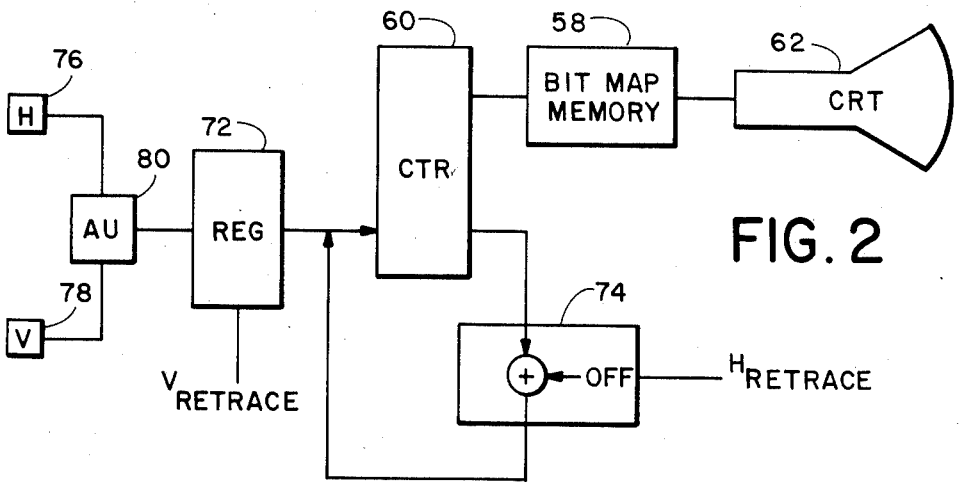

Referring to the drawings and particularly to FIGS. 1*a* and 1*b*, the memory space within a pixel bit map memory is illustrated at 54 and a "viewport" 56 is illustrated as a window within the memory space 54. Referring to FIG. 2, bit map memory 58 is consecutively addressed by counter 60 and read out to provide a display of the addressed pixels on cathode-ray-tube 62. Returning to FIG. 1*b*, assume pixels depicting a cylinder 64 are stored in the bit map memory, but the viewport 56 is defined at the location illustrated in FIG. 1*b*. Therefore, only the portion of the cylinder 64 shown in full line will be displayed on the face of the cathode-ray-tube, in exactly the same manner as shown within viewport 56 in FIG. 1*b*. In a typical instance, the bit map memory size is 1024 pixel bits by 1024 pixel bits, but the viewport comprises a space 640 pixel bits in the horizontal direction by 480 pixel bits in the vertical direction. The origin or point having an address (0,0) for the bit map memory is indicated at 66, and the origin or starting address of the viewport 56 is located at 68 in FIG. 1*b*. A cursor 70 is positionable by a mouse or other graphical input device anywhere within the virtual image space 54.

In accordance with the present invention, the viewport 56 may be panned within the virtual image space of the bit map memory 54 by moving the cursor 70 against the edge of the viewport 56. For example, if the cursor 70 is moved to make a transition across the left hand edge of the view-port 56 in FIG. 1*b*, the viewport 56 will follow the cursor as long as the cursor goes no farther than the left hand edge of the virtual image memory space 54. In FIG. 1*a*, rectangle AB represents the most extreme position that the viewport 56 can be toward the origin 66, and rectangle CD represents the most extreme position that viewport 56 can be away from the origin. The movement of the viewport as defined by movement of its origin 68 is constrained to remain within rectangle AC. Of course, the particular sizes for the virtual image memory space and the viewport are given by way of example and could be changed even during the operation of a given apparatus.

Referring once more to FIG. 2 it will be recalled that the bit map memory 58 is consecutively addressed from counter 60, with counter 60 cycling through addresses for the viewport it is desired to present on cathode-raytube 62. Since only a portion of the addresses in memory 58 is to be accessed, counter 60 does not count through all possible addresses, but only through the desired addresses. In particular, counter 60 is loaded at every vertical retrace time with a value representing the origin 68 in FIG. 1*b* of the desired viewport from viewport register or pan register 72. The counter 60 is then clocked to count through successive addresses in bit map memory 58 representing a first horizontal "line" of pixels for display on CRT 62, the line comprising 640 consecutive addresses in the present example, and the counter then waits for the horizontal retrace signal from the cathode-ray-tube circuitry (not shown). Thereupon, the counter 60 is clocked again for accessing the pixels for the next line, etc. Between lines, an offset value is added to the output of counter 60 in adder 74, and the previous value in counter 60 plus the offset is preloaded back into counter 60. The reason for adding this offset will be appreciated from viewing FIG. 1*b*. If a horizontal line of pixels, illustrated by dashed line 82 in FIG. 1*b*, is traced upon the cathode-ray-tube screen for portraying one line of pixels within the viewport, it will be understood that after the conclusion of line 82 a value must be added to the last address for line 82 in order to reach the first address for line 84. The addition value comprises the number of pixels in line segment 86 between the right hand edge of the viewport and the right hand edge of the bit map plus the number of pixels in the line segment 88 between the left hand side of the pixel bit map and the left hand side of the viewport. In the present example, the added value equals 1024 minus 640 or 384. This will differ for different embodiments.

At each vertical retrace time, the counter 60 is reloaded from register 72 with the offset representing the origin or start of the viewport. The viewport is panned or moved relative to the bit map by changing the value in pan register 72. At each next vertical retrace time, counter 60 can be preloaded with a different value and the viewport will start at a new location.

It should be noted that memory 58 is a linear array at consecutive addresses and does not necessarily correspond to X and Y locations on a cathode-ray-tube screen. In the FIG. 2 circuit, horizontal or X addresses are input to register 76 and vertical or Y addresses are input to register 78. As hereinafter more fully described, these X and Y addresses may be derived from the positioning of the mouse or other graphical input device employed to position the cursor on the screen of the cathode-ray-tube. The X and Y addresses are converted to a linear array address for input to register 72 in arithmetic unit 80 in a known manner. In particular, arithmetic unit 80 converts the H and V values in registers 76 and 78 to a desired output according to the formula:

(starting point)+V (width between lines)+H where the starting point here represents the address of origin 66 in FIG. 1*b*.

Figure 3:
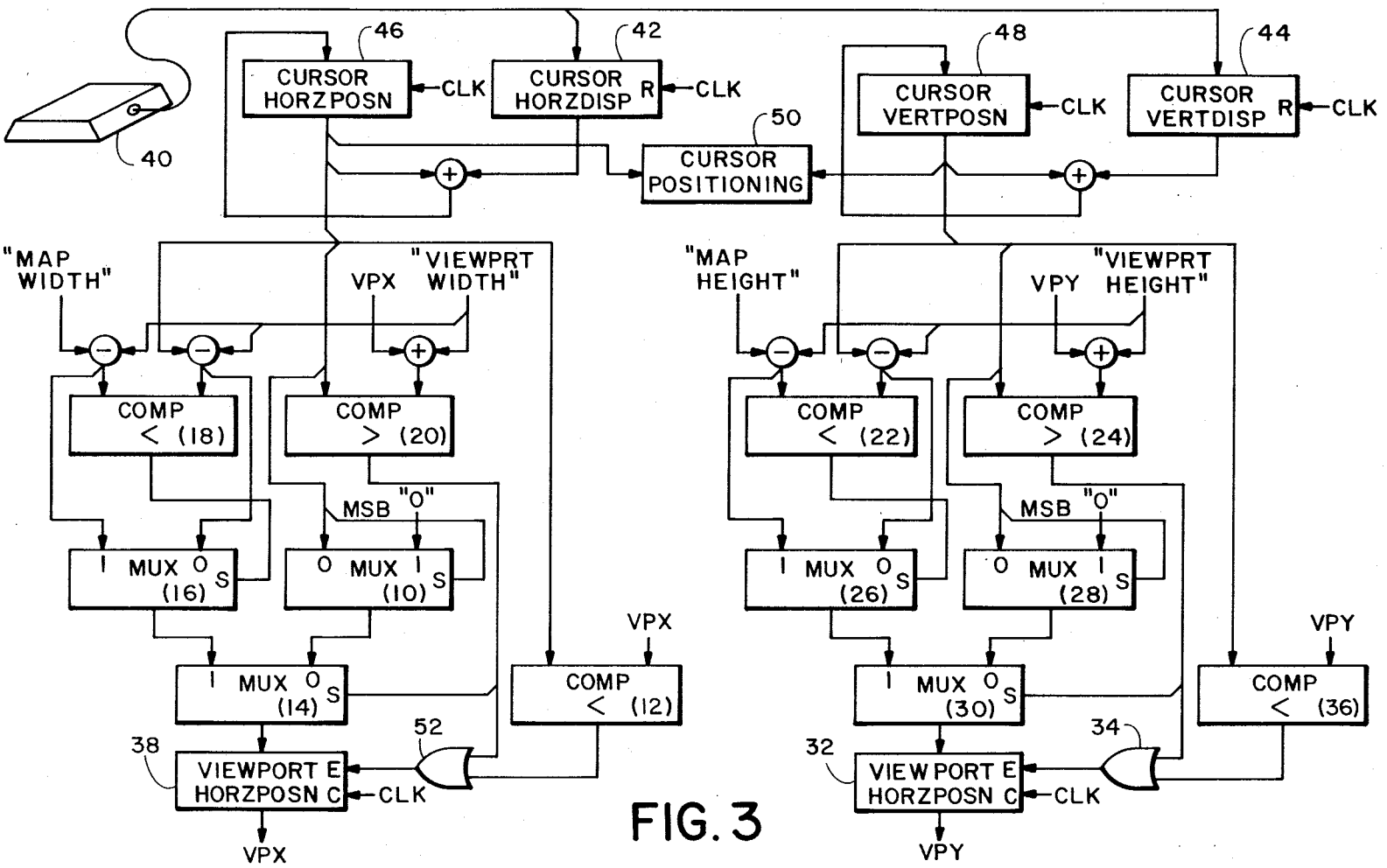

Referring to FIG. 3, a mouse 40 or other similar graphical input device is employed for converting relative physical movement into an electrical input. In a particular embodiment, the mouse utilized was manufactured by Hawley Labs of Berkeley, California. The mouse is movable manually over a flat surface (not shown) and supplies quadrature encoded output signals used to operate displacement counters 42 and 44 in a manner for incrementing or decrementing the displacement counters depending upon the extent and direction of movement of the mouse in respective horizontal and vertical component directions. Periodically, on a clock cycle basis, the displacements from counters 42 and 44 are added to cursor horizontal position register 46 and cursor vertical position 48 respectively, and the displacement counters 42 and 44 are reset to zero. The outputs of cursor horizontal position register 46 and cursor vertical position register 48 are supplied to cursor positioning circuitry 50 which controls the position of the cursor on the cathode-ray-tube screen in a conventional manner. In particular, the output of the cursor positioning circuitry provides an input to the pixel bit map memory whereby the previous cursor position as stored in the pixel bit map memory is erased and the new pixel position is stored therein assuming the cursor has moved.

In accordance with the present invention, the graphical input device or mouse is utilized for moving the viewport substantially simultaneously with the cursor, in the instance where the cursor is moved by the mouse to encounter one of the edges of the viewport. As the mouse is moved, the viewport then appears to move along with the cursor as the cursor "pushes" the viewport in the direction of cursor movement. The viewer can thus explore parts of the pixel bit map that lie beyond the viewport as previously displayed.

The cursor horizontal position from register 46 is provided to comparator 12 which compares the horizontal position of the cursor from register 46 with the horizontal position of the viewport, VPX (derived from register 38). If the cursor horizontal position is less than VPX, it will be seen that the cursor is to the left of the viewport, and the updating of register 38 at the next clock is enabled via OR gate 52 connected to receive the output of the comparator. Assuming the cursor has not moved entirely off the virtual screen represented by the bit map, then the cursor horizontal position will be supplied to register 38 by way of the "0" input of multiplexer 10 and "0" input of multiplexer 14. Register 38 is thus updated to represent the horizontal position of the cursor, and supplies the new VPX value for register 76 in FIG. 2. (Registers 38 and 76 can be the same register. As will be seen, the pan register 72 will be correspondingly updated whereby the origin or starting point 68 of the viewport will be shifted (so far as its X coordinate is concerned) to coincide with the new position of the cursor. Consequently, it will appear as if the cursor has "pushed" the viewport in the direction and by the displacement of the cursor movement beyond the previous viewport. As hereinbefore mentioned, the contents of register 72 in FIG. 2 are used to update counter 60 at each vertical retrace time.

The most significant bit of the cursor horizontal position is employed as a select input of multiplexer 10. The most significant bit is treated as a sign bit, with negative numbers being typified by the most significant bit being one. If the cursor has moved entirely to the left of the virtual screen represented by the bit map, then multiplexer 10 will output a zero causing register 38 to be reset to zero since the viewport is not desirably moved any farther to the left then the zero X coordinate.

The case will now be considered where the cursor is moved to the right hand side of the viewport. Comparator 20 compares the horizontal cursor position from register 46 with (VPX+viewport width). Thus, a comparison is made between the horizontal cursor position and the right hand side of the viewport. If the cursor horizontal position is greater than the above-mentioned sum, then the updating of register 38 is again enabled by way of OR gate 52.

The output of comparator 20 will also operate the select input of multiplexer 14 whereby the output of multiplexer 16 is provided as the input to register 38. If the cursor is to the right of the viewport, we choose the minimum of the right hand side of the bit map, or the cursor position if the cursor has not moved beyond it. Comparator 18 determines whether (map width—viewport width) is less than (cursor horizontal position—viewport width). If it is not, then multiplexer 16 selects (cursor horizontal position—viewport width) as the new input for register 38. As will be seen, this is the case where the cursor has moved off the right hand side of the viewport, but has not exceeded the bit map. The viewport width is subtraced from the cursor position before updating register 38 since register 38 is used in updating the origin of the viewport and it will be seen such origin is the width of the viewport away from the right hand side of the viewport. In effect, comparator 18 compares map width with cursor horizontal position and if the cursor horizontal position is less than map width, register 38 is updated with the new cursor position. If, on the other hand, map width is less than the new cursor position, indicating a cursor has moved off the map, then the "1" input of multiplexer 16 is selected and the quantity (map width—viewport width) will be input to register 38. As will be seen, this places the viewport against the right hand side of the map.

Similarly, comparator 36 compares the cursor vertical position with VPY or the current viewport vertical position (from register 32). If the cursor position is less than VPY, indicating movement of the cursor off the top of the viewport, then updating of register 32 at the next clock is enabled with OR gate 34. Assuming the cursor has not moved entirely off the bit map, the cursor vertical position will be delivered to the view port vertical position register 32 through multiplexers 28 and 30. Where the cursor vertical position has moved off the top of the viewport, the vertical position of the viewport will thus be moved to the vertical position of the cursor. Register 32 will update register 78 in FIG. 2 and may comprise the same register. If the cursor has moved entirely off the top of the bit map, then the most significant bit of cursor vertical position will be a one and multiplexer 28 will select zero as the input for register 32 whereby the new viewport will be positioned vertically against the top of the bit map.

Now considering the case where the cursor has moved from the bottom of the viewport, comparator 24 determines whether the current vertical position of the cursor in register 48 is greater than (VPY+viewport height) and if it is, then updating of register 32 is enabled via OR gate 34.

Comparator 22 determines whether (map height—viewport height) is less than (cursor vertical position—viewport height). Map height minus viewport height is that position for the viewport where the viewport is against the bottom of the bit map. If this is less than cursor vertical position minus viewport height, then the cursor has moved from the bottom of the bit map and the "1" input of multiplexer 26 is selected by comparator 22. Consequently the aforementioned vertical position for the viewport where it is against the bottom of the bit map is selected for input to register 32 by way of multiplexers 26 and 30. If the cursor is not off the bottom of the bit map, then the "0" input of multiplexer 26 will be coupled to its output, and register 32 will receive (cursor vertical position—viewport height) as the new vertical position for moving the bottom edge of the viewport to the new cursor position.

Thus the register 72 is updated in accordance with cursor movement under control of the mouse so that the viewport is moved along with the cursor when the cursor encounters the edge of the viewport, thereby providing easy panning of the viewport without requiring any additional control beyond that supplied for the cursor.

In a preferred embodiment of the present invention, the operation between the mouse input and the hardware associated with the bit map circuitry of FIG. 3 is carried out in a microprocessor system wherein the relative mouse movements are received and the cursor and viewport are positioned in response thereto. Again, when the cursor makes a transition from inside the viewport to outside the viewport, the viewport is moved accordingly. Reference is made to the flowchart of FIG. 4 describing the overall process as implemented on a Motorola 68000 microprocessor.

Mouse movement as referenced by block 90 provides an indication of relative X and Y motion in block 92. The cursor position represented by block 94 is updated in accordance with the relative motions by an addition noted at 96, and the new cursor position is stored. In accordance with the new cursor position, the cursor is actually moved to the new position in the block 98 after which it is determined in decision block 100 whether the cursor in its new position is inside or outside of the viewport. If the cursor is inside the viewport, no action is taken. If the cursor is outside the viewport, the viewport position (the X,Y coordinates of point 68 in FIG. 1*b*) is adjusted so the cursor is just visible. The new viewport position, block 101, is available for the test described by decision block 100.

Figure 4:
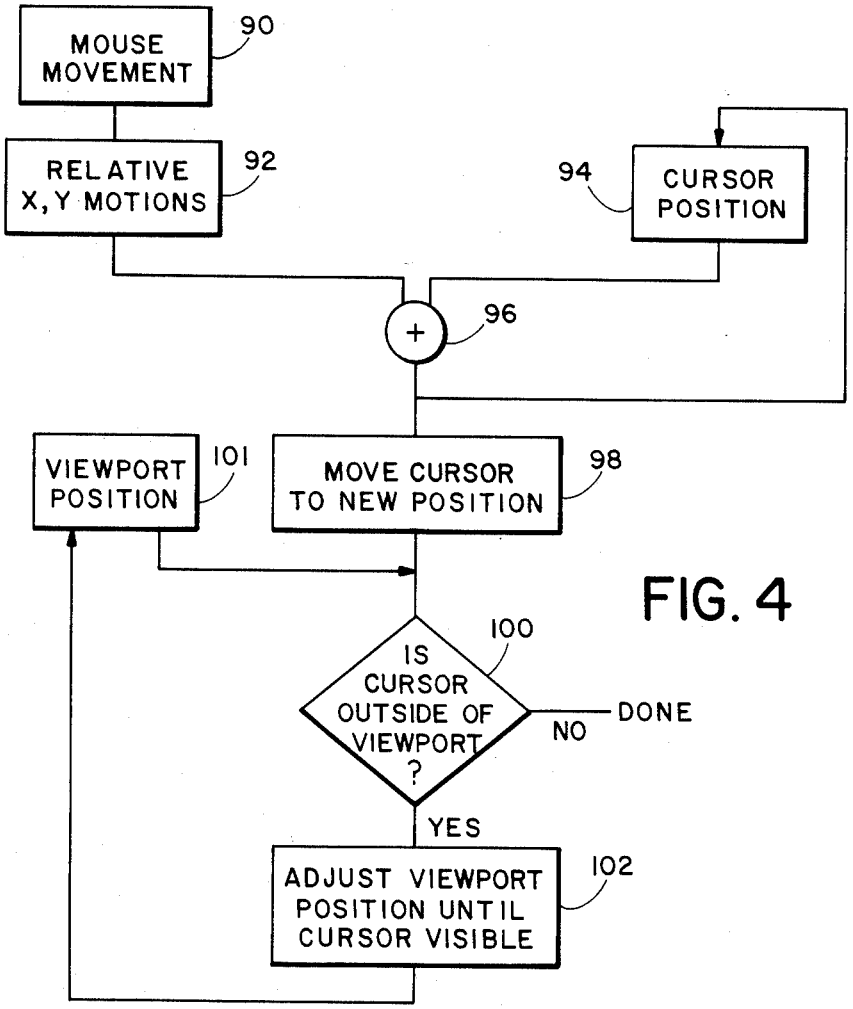

The software for carrying out the FIG. 4 procedure is more fully described as follows:

```
/* Get new mouse position */
if mousePositionChanged then
    newMousePoint = mousePoint+getMouseDeltas()
    newCursorPosition=newMousePoint
if in_viewport(cursorPosition) &
not in_viewport(newCursorPosition)
    then /*pan until new cursor in_viewport or pan limits
    reached*/
        if newCursorPosition.x< ViewPort.x
            then newViewPort.x = max(newCursorPosition.x,
            minViewPortX)
        else if newCursorPosition.x> ViewPort.x+
        viewPortWidth
            then newViewPort.x =
            min(newCursorPosition.x-viewPortWidth,
            maxViewPortX)
        if newCursorPosition.y< ViewPort.y
            then newViewPort.y = max(newCursorPosition.y,
            minViewPortY)
        else if newCursorPosition.y> ViewPort.y+
        viewPortHeight
            then newViewPort.y =
            min(newCursorPosition.y-viewPortHeight,
            maxViewPortY)
/* if the cursor has moved and it had been visible, erase the old
cursor image */
if newCursorPosition <> cursorPosition then
    restore area under old cursor position
    cursorVisible = false
    endif
/* change the pan register if the view port position has changed */
if newViewPortPoint <> viewPortPoint
```

-continued

```
    then change the physical view port position
/* if the cursor is not display and should be then display it */
if not cursorVisible
    then cursorPosition = newCursorPosition
        display cursor at cursorPosition
        cursorVisible=true
```

In the foregoing program and in particular in the first four lines thereof, a check is made to see if the mouse position has changed. The mouse deltas correspond to the entry in counters 42 and 44 in FIG. 3. A new mouse point is then calculated which corresponds to the last position of mouse plus the mouse deltas and the new cursor position is immediately defined as the new mouse point in the fourth line of the program. Therefore, the cursor is tracking the mouse.

In the fifth through the twentieth lines of the program (lines 6 through 21 of the application), a test is made to determine if the new cursor position is outside the viewport and if this represents a change from the previous cursor position. The viewport is then panned until the new cursor is within the viewport or the pan limit (i.e. the edge of the bit map) is reached.

A series of comparisons are made to indicate the boundary of the viewport that has been crossed, i.e. top, bottom, left, or right. The first comparison determines whether the new cursor position X coordinate is smaller than the present viewport position. If it is, the cursor has moved to the left of the viewport, and a new X coordinate for the viewport is computed whose value is going to be the maximum of either the new cursor position or the smallest possible viewport value.

The next test checks to see whether the X value has exceeded the present viewport origin plus its width (which indicates the cursor has moved off the right side of the viewport). In that case the new viewport's X origin is made the smaller of the cursor position minus the width of the viewport or the maximum value the viewport can be set to.

Similarly for the Y value, if the new position of the cursor is smaller than the viewport Y coordinate, then the new viewport's Y will be made the maximum of the new cursor position or the minimum viewport Y. Considering movement off the bottom of the viewport, if the new cursor position's Y is greater than the viewport's Y plus the viewport height, then a new Y value for the viewport's origin is computed which is the smaller of the cursor position's Y minus the viewport height or the maximum viewport Y value. As a result of the aforementioned tests the new position has been determined for the viewport to occupy.

In the twenty-first through the twenty-sixth lines of the program (lines 22 through 27 of the application) the full cursor image is erased in the bit map if the cursor has moved, as determined in the fourth line of the program. If the new cursor position is less than or greater than the previous cursor position then the bit map area under the old cursor position is restored. (The cursor is erased.)

In lines 27 through 29 in the program (lines 28–30 in the application), the pan register is changed if the viewport position has changed. If the new computed position for the viewport is less than or greater than the previous viewport position, then the value in the pan register is changed so that the viewport will exhibit a new location. X and Y inputs are as provided to registers 76 and 78 in FIG. 2. The computations indicated for arithmetic unit 80 in FIG. 2 are carried out.

Finally, in the last five lines of the program, the cursor is made visible at the new position. Thus, both the cursor and the viewport have been moved in accordance with the change in mouse position, assuming the cursor has crossed a viewport boundary.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method of providing a display movable relative to information stored in a pixel bit map memory, comprising:

addressing a portion of said pixel bit map memory to define a visible display wherein the portion addressed represents a viewpoint into the bit map memory, said pixel bit map memory storing a virtual image of greater height and width than is includable within said viewpoint, controlling the positioning of a cursor relative to the display, said cursor being movable relative to said display by an arbitrary displacement in two dimensions, detecting the position of said cursor relative to x and y addresses for the bit map memory which represent said viewport in order to determine whether the cursor falls within said viewport, and altering said addresses as applied to said bit map memory for relatively moving said viewport toward said cursor so as to include said cursor within the visible display when the current position of said cursor is detected as falling outside said viewport wherein said addresses are altered by an arbitrary differential corresponding to said displacement in two dimensions.

2. A method of providing a display movable relative to information stored in a pixel bit map memory, comprising:

storing information in said bit map memory in the form of display pixels, addressing a portion of said bit map memory to define a visible display wherein the portion addressed represents a viewport in the bit map memory, said bit map memory storing a virtual image of greater height and width than is includable within said viewport, said addressing including counting from a starting address representing the offset of said viewport relative to said virtual image of greater height and width in said bit map memory, wherein said counting continues for providing a horizontal line of pixels for the display and is reinitiated upon horizontal retrace in said display, and wherein a constant value is added to the count at the end of each horizontal line of pixels and before reinitiation of counting in order to address the leading edge of the viewport, controlling the positioning of a cursor relative to the display, said cursor being movable relative to said display by an arbitrary displacement in two dimensions, detecting the current position of said cursor in said two dimensions relative to the addresses for the bit map memory which represent said viewport in order to determine whether the cursor falls within said viewport, and altering said addresses as applied to said bit map memory by changing said starting address when said cursor is detected as falling outside said viewport for relatively moving said viewport so that said cursor is detected as falling inside said viewport so that said cursor is detected as altered by an arbitrary differential corresponding to said displacement in two dimensions.

3. The method according to claim 2 wherein said altering of said addresses is accomplished by altering said starting address representing the offset of said viewport.

4. The method according to claim 3 wherein said starting address is altered to a value such that the cursor falls proximate the beginning or ending of a horizontal line in said viewport or proximate the first or last horizontal line of said viewport according to the closest edge of said viewport relative to said cursor.

5. The method according to claim 2 wherein said starting address is changed to the address of the cursor as detected as falling outside said viewport for the coordinate direction of the displacement of said cursor outside said viewport.

6. The method according to claim 2 wherein said counting from a starting address is reinitiated upon each vertical retrace in said display.

7. The method according to claim 2 wherein said controlling the positioning of a cursor includes physically moving an input device by an arbitrary amount, detecting the relative movement thereof as an increment or decrement, and totaling increments and decrements to provide a position for said cursor relative to the bit map addresses.

8. Apparatus for providing a display movable relative to stored information comprising:

a display means, a pixel bit map memory for storing pixel information for display on said display means, means for scanning addresses in said pixel bit map memory for accessing pixel data and consecutively applying said data to said display means, wherein said means for scanning scans less than the total bit map memory whereby the display of said display means is a partial representation in terms of height and width of information stored in said pixel bit map memory, means for providing a movable cursor representation on said display means relative to pixel information stored in said pixel bit map memory, physically operable means for moving said cursor representation by an arbitrary distance with respect to said pixel information, means for detecting whether said cursor representation falls within the said partial representation of information, and means for altering the scanning of said addresses when said cursor representation falls outside said partial representation of information so as to include said cursor representation within said partial representation of information wherein said addresses are altered by an arbitrary differential corresponding to said displacement in two dimensions.

9. The apparatus according to claim 8 wherein said physically operable means comprises a mouse.

10. The apparatus according to claim 8 wherein said scanning means comprises a counter for counting through at least selected addresses of said pixel bit map memory, and means for preloading said counter with a value representing a starting address in said memory where said partial representation of information is stored.

11. The apparatus according to claim 10 wherein said means for altering the scanning of said addresses when said cursor representation falls outside said partial representation of information comprises means for altering the preloading of said counter by said preloading means to select a new partial representation of information including said cursor representation.

* * * * *